United States Patent [19]

Frémaux et al.

[11] Patent Number: 4,564,404

[45] Date of Patent: Jan. 14, 1986

[54] INERT PASTE OF THE NITRATE-FUEL TYPE, EXPLOSIVE PRODUCT OBTAINED THEREFROM BY THE INCORPORATION OF AIR AND PROCESSES OF MANUFACTURE THEREOF

[75] Inventors: Jacques M. Frémaux, Haisnes, France; Hans W. Ehrlich, Colchester, United Kingdom

[73] Assignee: Societe Anonyme d'Explosifs et de Produits Chimiques, France

[21] Appl. No.: 559,758

[22] Filed: Dec. 9, 1983

[30] Foreign Application Priority Data

Dec. 10, 1982 [FR] France ..... 82 20786

[51] Int. Cl.[4] ..... C06B 45/02

[52] U.S. Cl. ..... 149/21; 149/2; 149/46; 149/6 D; 149/109.6

[58] Field of Search ..... 149/2, 21, 46, 60, 109.6

[56] References Cited

U.S. PATENT DOCUMENTS

| | | | |
|---|---|---|---|
| 3,288,658 | 12/1966 | Ferguson | 149/60 |
| 3,919,015 | 11/1975 | Bolza | 149/42 |
| 3,923,565 | 12/1975 | Sakai | 149/60 |
| 3,925,123 | 12/1975 | Jessop | 149/60 |
| 3,940,297 | 2/1976 | Bolza | 149/42 X |
| 4,111,727 | 9/1978 | Clay | 149/2 |
| 4,330,346 | 5/1982 | Alm et al. | 149/44 X |
| 4,331,490 | 5/1982 | Palgrave et al. | 149/46 |

*Primary Examiner*—Stephen J. Lechert, Jr.

*Attorney, Agent, or Firm*—Bacon & Thomas

[57] ABSTRACT

Paste of the water-ammonium nitrate-fuel type, free of explosive elements, inert in manufacture, shipping and storage due to the fact that it does not contain air or not in a sensitizing form. A gum is used as a cross-linking agent. The product is an explosive pumpable on site by the incorporation of air.

11 Claims, 1 Drawing Figure

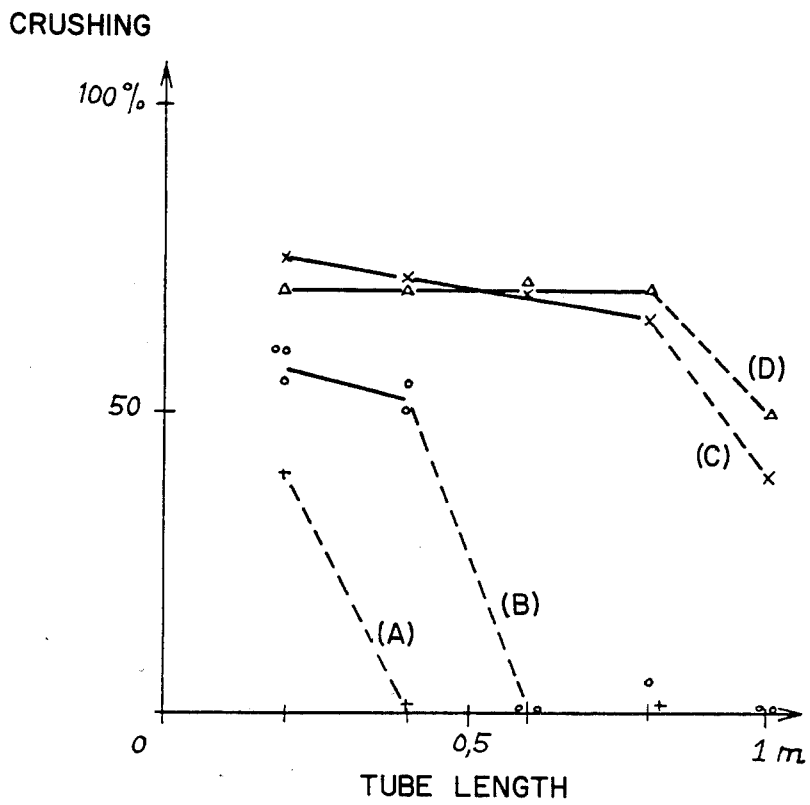
CRUSHING
100 %
50
0
0,5
1 m
TUBE LENGTH
(A)
(B)
(C)
(D)

INERT PASTE OF THE NITRATE-FUEL TYPE, EXPLOSIVE PRODUCT OBTAINED THEREFROM BY THE INCORPORATION OF AIR AND PROCESSES OF MANUFACTURE THEREOF

BACKGROUND OF THE INVENTION

The present relation relates to a paste of the nitrate fuel type, which is inert (or insensitive) during its manufacture, its transportation and its storage, is stable during the latter, and can easily be transformed on the firing site into a powerful, pumpable explosive material having interesting additional characteristics.

Nitrate-fuel combinations have long been known. Also "pastes" are known containing these elements and conventional additives.

Two families of pastes are to be distinguished. The first generation of products of this type contained explosive substances as a sensitizer.

Since then a second generation of pastes has been developed containing air as sensitizer.

On this subject it will be noted that it is moreover impossible until now to avoid incorporating air in a considerable amount in the pastes, during manufacture.

Thus, all known pastes contain an amount of air such that they are not inert, and this from their manufacture, which presents obvious drawbacks particularly in the field of safety.

GENERAL DESCRIPTION OF THE INVENTION

It is an object of the present invention to preserve the known advantages of combinations of the nitrate-fuel type, which it is only known at present to manufacture in solid and immediately explosive form, that is to say, non-inert, but to manufacture on this basis a paste which is inert during manufacture, transportation and storage, and which enables the preparation on the firing site, as simply as possible, of a powerful explosive which is itself pumpable and has a group of interesting properties.

These objectives are achieved by the pastes according to the invention of which the characteristic is not to contain air, or at least not in sensitizing form.

Taking into account present knowledge in this field and marketed products, the production of such a paste free from air, free from explosive substances and physically stable (no separation of phases) for a very long period did not appear possible to the technician skilled in the art, in spite of the major interest of such a product.

This result can however be achieved by using in doubly original manner, at the level of function and at the level of the amount used, a known product and long used within the technical sector concerned.

It has in fact been discovered according to the invention that, in a generally known system, of the type:

- water
- ammonium nitrate (combustion supporting component) alone or in admixture with certain soluble alkaline (sodium) or alkaline-earth (calcium) nitrates, in limited amounts
- fuel: fuel, gasoil and fuels belonging substantially to the hydrophobic family and their mixtures, powdered aluminum, etc.
- hydrating gums
- crosslinking agent, the function of the cross-linking agent could be fulfilled by a self-cross linking gum when the latter is used in much smaller proportion (some hundreds of ppm) than in the range of its usual employment (of the order of 1%).

Used in particular for this purpose, according to the invention, is "GUARTEC 417", a gum marketed by the General Mills Company.

According to the invention, this gum is used in very low doses and causes the very slow cross linking of two hydrating gums contained in a synergistic mixture which will be described below, according to a preferred embodiment.

A second essential element of the invention resides in the incorporation of a combination of a surface active agent and of a powerful solvent for this surface active agent.

It has been indicated above that the purpose of the invention was to obtain a paste devoid of sensitizing air.

However, another object of the invention is to obtain a paste which can be easily reactivated on site, for example by the introduction of fine air bubbles into the inert mass to sensitize it.

It is necessary also for the inert paste to be stable on storage, hence to avoid the separation of the aqueous phase and of the fuel.

These contradictory requirements are satisfied according to the invention by the use in combination of a very easily foaming surface active agent (which is paradoxical taking into account the fact that it is desired to incorporate as little air as possible) and a powerful solvent of the DMSO type (dimethylsulfoxide).

It has been discovered that this combination enables the surface active agent to fulfill two essentially different functions:

- during the preparation of the paste, it is possible to stabilize the fuel dispersion whilst avoiding foaming, and this stability is preserved on storage;
- during sensitization (that is to say transformation of the inert paste into an explosive on site) the surface active agent present in the mass facilitates the incorporation of fine air bubbles or of the sensitizing gas (oxygen, etc.) in the paste, if this method of sensitization—which is the simplest—is employed.

It must be noted that all surface active agents are not suitable. This is the case in particular with the more usual surfactants, like for example alkylarylsulfonates. With laurylsulfate, particularly, The gasoil phase separates in some weeks. Also products having an epoxy bridge are avoided.

The best results have been obtained with a combination:betaine derivative+DMSO.

It has been specified above that the inert paste obtained according to the invention be pumpable, which represents an essential advantage.

It can hence be sensitized very simply by the incorporation of air on site, or of a different sensitizing gas, which incorporation is rendered particularly effective by means of the special choice of surface active agent and of its solvent.

Of course, on site, the sensitized paste can be packaged for its transportation up to the place of firing proper.

As a modification, it is also possible to sensitize the inert paste by the incorporation, in known manner, of hollow glass beads, of bakelite and of similar materials and to carry out packaging.

At this stage, the activated paste has two additional advantages:

although pumpable, it is however rather viscous to resist water easily (which is important since it frequently happens on work sites that water is encountered at the bottom of the firing holes); the technician skilled in the art knows that, starting from the type of component described above, this compromise between pumpability and water resistance, which are two contradictory characteristics, is extremely difficult to realize: the invention comes in here, probably by reason of the special and unexpected cross-linking properties of GUARTEC gum used for this purpose.

the lifespan of the explosive (the order of 100 h), that is to say of the paste after its sensitization, is: sufficiently long to permit a delayed firing, which frequently happens on the work sites, but are sufficiently short so that, fairly rapidly, the explosive again becomes inert (probably by coalescence of the air bubbles introduced). Thus, in case of loss, of omission, of theft of explosive, the latter ceases very rapidly to be dangerous.

Of course, this lifespan of the explosive (of the order of 100 h) must not be confused with the lifespan on storage of the inert paste which, itself, is very long: of the order of a year.

According to the invention, there is used as "hydrating gum", in fact, an original combination of two gums and a polyacrylamide.

This combination is as follows:

(a) partly depolymerized basic gum, (b) bipolymerized gum, of which the hydration is very rapid in water but very slow in the starting ammonium nitrate solution, (c) polyacrylamide whose function is double:

(i) hydration, (ii) formation of a gel with a filamentous character.

The gums (a) and (b) were selected so as to be cross-linked by GUARTEC gum used according to the invention as a cross-linking agent. Polyacrylamide will not of course be cross-linked.

This mixture participates in the obtaining of the properties of the inert paste according to the invention, by reason of the fact that is sufficiently fluid but possesses nonetheless a "filamentous" character conferring on it a consistency analogous to that of chewing gums.

Particularly, taking into account also the presence in the inert paste of a very foamy surface-active agent, as indicated above, it will be possible to create by simple aeration of the paste on site, a very sensitizing very fine network of air bubbles or of sensitizing gas.

The process of manufacture that is provided according to the invention must be such that it introduces also as little air as possible into the paste, which is extremely difficult with known pastes and processes.

The process employed according to the invention comprises four principal steps.

(I) A portion of the nitrate (representing about 30% by weight of the total mixture) is dissolved in water and to this solution is added the rest of the nitrate, which constitutes the first step.

(II) In addition, there is prepared separately a mixture consisting of a part of the fuel or gasoil, the cross-linker according to the invention, (gum "GUARTEC"), and the first hydrating gum (a) described above. The mixing time was about one hour. The addition of this mixture to the solution (I) constitutes step (II).

(III) Step (III) consists of adding then a mixture consisting of:

the rest of the fuel (or of the gasoil)

the second hydrating gum (b) described above polyacrylamide (c).

(IV) The fourth step consists of adding the surface-active agent and its solvent.

The amount of air introduced may be controlled by measurements and calculations of densities.

The theoretical density (that is to say total absence of air) of the inert paste according to the invention is 1.38–1.39.

When operating non-industrially, that is to say by taking precautions (manual mixing, etc.) incompatible with acceptable costs, the density obtained is about 1.37, a value very slightly less than the theoretical density.

The advantage of the invention is that, even by operating industrially, and even very rapidly since it is recommended to employ for the different steps a rapid mixer, for example, a "Lödige" blade type, the density does not drop generally beneath about 1.35, which manifests the slight amount of air introduced.

With a laboratory blade type mixer, the mixing times for the four steps are about:

(I) 5 seconds (II) 5 seconds (III) 10 seconds (IV) 5 seconds.

These values are important and have been long in determination.

It will be noted that if a poorly adapted mixer is used, for example a ribbon mixer for powders, the density of the paste falls to about 1.30.

It must also be noted that, taking into account the starting products used according to the invention, and the density of about 1.35 obtained by an industrial technique, the technician skilled in the art would consider that the paste obtained should have the characteristics of an explosive.

Now, if it is subjected to a very severe detonability test of the ECM, [Appendix II of the *Official Journal of the European Community* No. 1250 of 23 Sept. 1980] it shows itself to be inert.

Without wishing to be limited by theory, Applicant considers that this behavior, contrary to what could be expected, is due to particularly slow kinetics of the cross-linking caused by the "GUARTEC" gum, which kinetics could not be foreseen since this gum and never been used, neither as cross-linking agent, nor in a comparable dose. This very slow-hydration cross-linking enables the escape of the major part of the included air.

The following examples illustrate the invention without however limiting the scope thereof.

DESCRIPTION OF PREFERRED EMBODIMENTS

EXAMPLE 1

Preparation of an inert paste

| Overall composition | |
|---|---|
| water | 10–14.5 (% by weight) |
| ammonium nitrate | 84.75–79.65 |
| fuel | 4.00–4.39 |
| gums | 0.51–1.13, or: |
| (a) Viscogum FP 200 | 0.55–0.22 |
| (b) GUARTEC LV | 0.11–0.28 |
| (c) BOZEFLOC NC | 0.18–0.33 |
| cross-linking agent | 0.02–0.06 (200–600 ppm) |

-continued

| | |
|---|---|
| surface-active agent | 0.22–0.44 |
| dimethyl sulfoxide | 0.11–0.22 |
| Detailed composition | |
| solution of ammonium nitrate: | |
| water | 12 (% by weight) |
| NA | 30 |
| solid ammonium nitrate | 52.57 |
| 1st fuel fraction | 1.1 |
| 2nd fuel fraction | 3.03 |
| (a) VISCOGUM FP 200 | 0.39 |
| (b) GUARTEC LV | 0.22 |
| (c) BOZEFLEC NC | 0.22 |
| GUARTEC 417 | 320 ppm |
| INTRAPHOR 171 | 0.33 |
| dimethyl sulfoxide | 0.11 |

Description of the elements (A) Ammonium nitrate

An element which occurs in the paste in two forms: one in aqueous solution and the other in solid form.

The aqueous solution is a solution whose crystallization temperature is preferably 32° C., but this example does not eliminate the use of solutions more or less charged with ammonium nitrate.

The solid ammonium nitrate is preferably a nitrate derived from the grinding of ammonium nitrate as "prill".

(B) Fuel

Conventional fuel element called domestic fuel, of density higher than 0.8 and whose flash point is situated beyond 55° C.

(C) Hydration gums (A) VISCOGUM FP 200: gum from the CECA Company whose origin is an extract of the endosperm of guar grain of the name Cyamopsis tetragonolobus. By more or less marked depolymerization of this original gum, it is possible to use a series of gums in particular VISCOGUM FP 200 whose aqueous solutions have a rheological character well adapted to the problem set.

(b) GUARTEC LV: gum from the General Mills Company (Henkel), modified for the production of a gel with relatively low viscosity.

GUARTEC LV reinforces the activity of VISCOGUM FP 200 in its essential function of constituting with the aqueous solution a viscosity phase enabling pumping.

Gelling gums obtained from starchy products such as "SOLVITEX Cp" marketed by the Paul DOITTAU Company, may advantageously replace GUARTEC LV.

(c) BOZEFLOC N 26: A synthetic polymer of the HOECHST Company: a polyacrylamide with very high molecular weight ($6\times10^6$), which is non-ionic.

This polymer gellified also aqueous solutions of ammonium nitrate, but does not cross-link with the cross-linking agent employed. It modifies the hydration and cross-linking kinetics of the two preceding gums. This effect is for the principal purpose of preserving, for a sufficient lapse of time, a minimal viscosity of the whole in order to permit coalescence of the air bubbles introduced during manufacture and enclosed in the mass, which coalescence prevents the air included from sensitizing the mass.

(D) GUARTEC 417

Self cross-linking gum used as a gelling agent in the profession at levels in the neighborhood, in the majority of cases of 1%. This gum could not be used as a hydrating gum, according to the invention, the viscosities being too high.

On the other hand, in infinitely smaller proportion (200–600 ppm), it possesses surprisingly all the qualities of a cross-linking agent and causes a cross-linking of the two gums (a) and (b) employed.

Employment necessitates a particular procedure.

In a hydrophobic element, such as fuel, by vigorous mixing, physical contact is produced between the Guar 417 and VISCOGUM FP 200.

This operation facilitates probable absorption of the Guar 417 gum on the VISCOGUM and causes very slow cross-linking.

The hydration-cross-linking phenomenon of the system finds its optimum realization within a pH span comprised between 5 and 6.

It is to be noted that this gum is self-cross-linking, that is to say possesses its own cross-linking elements, in very small amounts, and that nothing would not allow it to be assumed that itself, in minimum proportions, it would be capable of acting as a cross-linking agent.

(E) Surface-active agent

The dispersion of the fuel into a hydrophilic composition also charged with ionic element (ammonium nitrate), and the maintenance of the dispersion over time are facilitated by the use of a surface-active agent, INTROPHOR 171, of the DIAMOND SHAMROCK Company, of the family of alkylamido-betaïnes.

By the addition to the surface-active agent of a powerful solvent such dimethyl sulfoxide (DMSO), diffusion into the heart of the mass is improved, which permits the stirring time to be reduced and hence the introduction of too many air bubbles to be avoided in spite of the foaming nature of the surface-active agent, which is surprising.

Method of manufacture

The method of manufacture can be divided into four steps.

(I) Wetting of the solid ammonium nitrate by the aqueous solution of ammonium nitrate.

(II) Introduction of the first fuel fraction accompanied by VISCOGUM FP 200 and GUARTEC 417.

(III) Introduction of the second fuel fraction accompanied by GUARTEC LV and BOZEFLOC N 26.

(IV) Introduction of the mixture (surface-active agent+DMSO).

As a function of the dynamic mixer or malaxer adopted, the mixing time of each of these steps is variable. The mixing process employed is subject to the necessity of a final density as high as possible. Manual mixing, with a maximum of precautions, gives a final density of 1.37.

With a band mixer (powder mixer), after 15 minutes to 20 minutes, we obtain a density of 1.30.

With a spray and vortex mixer, of the Lödige type, the overall mixing time is 25 seconds to reach a density of 1.35. Of course, this list of various types of mixers is not exhaustive.

EXAMPLE 2

Utilization of the paste for explosive use

According to the criteria of explosability described in the standard described above of the Council of European Communities (test charge placed in a tube fixed on five lead layers. At the entrance of the tube, a Boostex is detonated. Then the degree of crushing of each layer is measure. The less the distant layers of Boostex are crushed, the less the explosion is propagated and hence the more inert is the test charge), the previously described paste is similar to an inert material. To activate this material, physical dispersion means for very fine bubbles of gas must be employed to create in this way an explosive of density less than 1.20.

On the exploitation site, it is possible to use a pulp, a Moineau pump for example, fed by an endless screw. Downstream of this pump is located a mixer, of the static type, to gasify the solid phase uniformly. The gaseous phase is introduced upstream of the static mixer. At the outlet from the static mixer, the paste shows all the characteristics of an explosive.

As a gas, air in particular, may be used. In the case of sensitization by aeration, the invention enables, due to aeration on site, the variation of the density of the explosive from the bottom of the hole to its orifice, as a function of the energy necessary, for example d=1.29 to d=1.10, which is impossible with conventional comparable explosives. In the case of the explosives according to the invention, it suffices to vary the flow rate of aerating gas.

Explosive characteristics

Firings are carried out in a steel tube of 80 mm diameter and 600 mm length, with priming by a Booster of type F 15 Dynamite of one diameter (that is to say of a length equal to the diameter of the tube).

The results (average values of detonation speed) were the following:

| Density | Detonation speed (m/s) |
|---|---|
| 0.8 | 4,850 |
| 1.0 | 5,500 |
| 1.2 | 6,100 |

These values enable the explosives according to the invention to be classed in the category of rapid explosives.

Power coefficient (coefficient of use in practice, CUP): about 1.

Limiting densities (the values above which an explosion is no longer produced):

diameter 50 mm: $d_l=1.17$ diameter 80 mm: $d_l=1.27$

The single appended figure shows the CEE test described above applied:

to sand (curve a), inert product, par excellence;

to the inert paste according to the invention (curve b)

to pure type agricultural ammonium nitrate (Ammonitrate) (curve c)

to pure industrial ammonium nitrate type B3 (curve d).

The test was conducted in a steel tube of 100 mm diameter, with priming by a Booster of type F 15 Dynamite of 1.5 kg (length=15 cm).

The curve obtained establishes the great inertness of the paste according to the invention, before sensitization on site.

We claim:

1. Inert, stable and pumpable paste of the water-nitrate-fuel type, said paste being non explosive in itself and not containing a sensitizing amount or form of air, said paste containing: (% by weight)

| | | |
|---|---|---|
| water | 10.00 | 14.5 |
| ammonium nitrate | 84.75 | 79.65 |
| fuel | 4.00 | 4.39 |
| hydration gums | 0.51 | 1.13 |
| cross linking agent (self cross-linking gum) | 0.02 | 0.06(200–600 ppm) |
| surface-active agent | 0.22 | 0.44 |
| solvent for the surface active agent | 0.11 | 0.22 |

2. Paste according to claim 1, containing: (% by weight)

| | |
|---|---|
| water | 12 |
| ammonium nitrate | 82.57 |
| fuel | 4.13 |
| hydration gums | 0.83 |
| cross-linking agent (self-cross-linking gum) | 0.03 (or 320 ppm) |
| surface-active agent | 0.33 |
| solvent for the surface-active agent | 0.11 |

3. The paste according to claim 1, wherein the surface active agent is an alkyl-amidobetaine; the associated solvent is dimethyl-sulfoxide; the cross-linking agent is a self cross-linking gum ("GUARTEC 417") and the hydration gum is a synergistic mixture containing a first gum, a second gum and a non-ionic high molecular weight polyacrylamide; wherein said first gum is a partly depolymerized extract of endosperm of guar grain of Cyamopsis tetragonolobus, and said second gum is a gum capable of forming a gel with relatively low viscosity.

4. The composition of claim 3, wherein the first gum is ("VISCOGUM FP200") being present in an amount of 0.39% by weight of the composition; and the second gum is ("GUARTEC LV") being present in an amount of 0.22% by weight of the composition.

5. A process for the preparation of a water-nitrate-fuel paste containing the following ingredients given in percentage by weight:

| | |
|---|---|
| water | 10–14.5 |
| ammonium nitrate | 84.75–79.65 |
| fuel | 4.00–4.39 |
| self cross-linking gum ("GUARTEC 417") | 0.02–0.06 (200–600 ppm) |
| surface active agent | 0.22–0.44 |
| dimethyl sulfoxide | 0.11–0.22 |
| hydration gum: | |
| (a) ("VISCOGUM FP 200") | 0.22–0.55 |
| (b) ("GUARTEC LV") | 0.11–0.28 |
| (c) ("BOZEFLOC NC") | 0.18–0.33; |

said process having the steps:

(i) dissolving a portion of the ammonium nitrate in the water to form a solution and then mixing the rest of the ammonium nitrate into the solution to form a wet mixture;

(ii) mixing a portion of the fuel accompanied by ("VISCOGUM FP200") and ("GUARTEC 417") into the wet mixture obtained in step (i);

(iii) mixing the remaining fuel accompanied by ("GUARTEX LV") and ("BOZEFLOC N26") into the mixture obtained in step (ii); and (iv) mixing the surface active agent in combination with the dimethyl-sulfoxide into the mixture obtained in step (iii).

6. Process according to claim 5 comprising the use for each step of a raid mixer, of the blade type for mixing the ingredients.

7. Process for the manufacture of a pumpable explosive, wherein air or a sensitizing gas is incorporated into an inert paste according to claim 1.

8. Pumpable explosive obtained by sensitization of the inert paste according to claim 1 by aeration on the firing site by air or a sensitizing gas.

9. Pumpable or cartridge-forming explosive obtained by the sensitization of the inert paste according to claim 1 by the incorporation of hollow beads of glass, or bakelite.

10. A method of making a water-nitrate-fuel paste composition of the type containing hydration gum which comprises the incorporation of 200–600 ppm of a self cross-linking gum into the composition.

11. An improved potentially explosive product of the type containing water, ammonium nitrate, fuel, hydration gum, and cross-linking agent; wherein the improvement comprises the use of a self cross-linking gum in the amount of 200–600 ppm as the cross-linking agent.

* * * * *